US010647506B1

(12) United States Patent
Kim

(10) Patent No.: US 10,647,506 B1
(45) Date of Patent: May 12, 2020

(54) TRASH CONTAINER LID LIFT SUPPORT

(71) Applicant: Kenneth Seok Kim, Carlsbad, CA (US)

(72) Inventor: Kenneth Seok Kim, Carlsbad, CA (US)

( * ) Notice: Subject to any disclaimer, the term of this patent is extended or adjusted under 35 U.S.C. 154(b) by 29 days.

(21) Appl. No.: 16/126,180

(22) Filed: Sep. 10, 2018

Related U.S. Application Data

(60) Provisional application No. 62/710,629, filed on Feb. 22, 2018.

(51) Int. Cl.
*B65F 1/16* (2006.01)

(52) U.S. Cl.
CPC .... *B65F 1/1623* (2013.01); *B65F 2001/1669* (2013.01)

(58) Field of Classification Search
CPC .. B65F 1/16; B65F 1/1623; B65F 2001/1669; B65D 25/2844; A01B 1/026; A45C 2013/223; A47G 23/02; A47G 23/0266
USPC .... 16/82, 422, 425, 426, 430, 443, DIG. 12, 16/DIG. 17, DIG. 19; 220/759
See application file for complete search history.

(56) References Cited

U.S. PATENT DOCUMENTS

| | | | | | |
|---|---|---|---|---|---|
| 2,618,497 | A * | 11/1952 | Gardels | E05C 17/042 | 292/265 |
| 5,203,471 | A * | 4/1993 | Widman | A47G 23/0266 | 220/755 |
| 6,138,855 | A * | 10/2000 | Kopf | B65F 1/1623 | 220/263 |
| 6,267,260 | B1 | 7/2001 | Lyons | | |
| 6,428,062 | B1 * | 8/2002 | Roehl | E05C 17/042 | 292/339 |
| 6,588,064 | B2 * | 7/2003 | Baum | A47G 23/0216 | 16/422 |
| 8,075,028 | B1 | 12/2011 | Porter | | |
| 8,517,211 | B2 * | 8/2013 | Brown | F25D 21/14 | 16/82 |
| 9,067,731 | B1 * | 6/2015 | Jackson | B65F 1/1623 | |
| 9,233,793 | B1 * | 1/2016 | Jackson | B65F 1/1646 | |
| 9,248,070 | B2 * | 2/2016 | Laccitiello | A61G 17/04 | |
| 9,505,552 | B2 | 11/2016 | Mak et al. | | |
| 2015/0353279 | A1 | 12/2015 | Azhocar | | |

* cited by examiner

*Primary Examiner* — Roberta S Delisle
(74) *Attorney, Agent, or Firm* — Harpman & Harpman

(57) ABSTRACT

A one-piece trash container and dumpster lid engagement lift and support device having an upper container engagement end and an oppositely disposed integrated handle grip portion. Recessed upper and lower central surface define lid and container engagement support areas after lid access is achieved to hold the lid open with aid without user engagement thereof.

8 Claims, 5 Drawing Sheets

TRASH CONTAINER LID LIFT SUPPORT

This application claims the benefit of U.S. Provisional Application No. 62/710,629, filed Feb. 22, 2018.

BACKGROUND OF THE INVENTION

1. Technical Field

This device relates to lid engagement and retainment devices that provide access and open retainment of container lids.

2. Description of Prior Art

Prior art devices of this type have been developed to aid in the nonuser contact of hinged container lids for opening and retaining the lid in open position. Examples can be seen in the following U.S. Patents. U.S. Pat. Nos. 9,505,552, 8,075,028, 6,267,260 and U.S. Publication 2015/0353279.

In U.S. Pat. No. 9,505,552, a lid opener is disclosed having an elongated handle with a pair of end projections extending at right angles therefrom.

U.S. Pat. No. 8,075,028 claims a trash container lift device having opposing contoured engagement ends on a central elongated handle there between with deployable storage hooks.

U.S. Pat. No. 6,267,260 illustrates a trash container door opening apparatus having a container engagement clamp with an extended curve lever for user engagement and opening without direct contact with the door.

U.S. Publication 2015/0353279 shows an apparatus for opening a container having elongated body member with oppositely disposed lid container engagement hooks.

SUMMARY OF THE INVENTION

A monolithic container lid engagement and support device having a tapered top and lid engagement portion for wedgeably lifting and lid engagement. A recessed top lid retainment portion with an oppositely disposed recessed bottom container engagement portion that allows the user to prop open and retain the lid of the container. An integral contoured handle extends between the top and bottom in opposed relation to the lid container engagement portion for direct user contact.

DETAILED DESCRIPTION OF THE INVENTION

Figure 1:
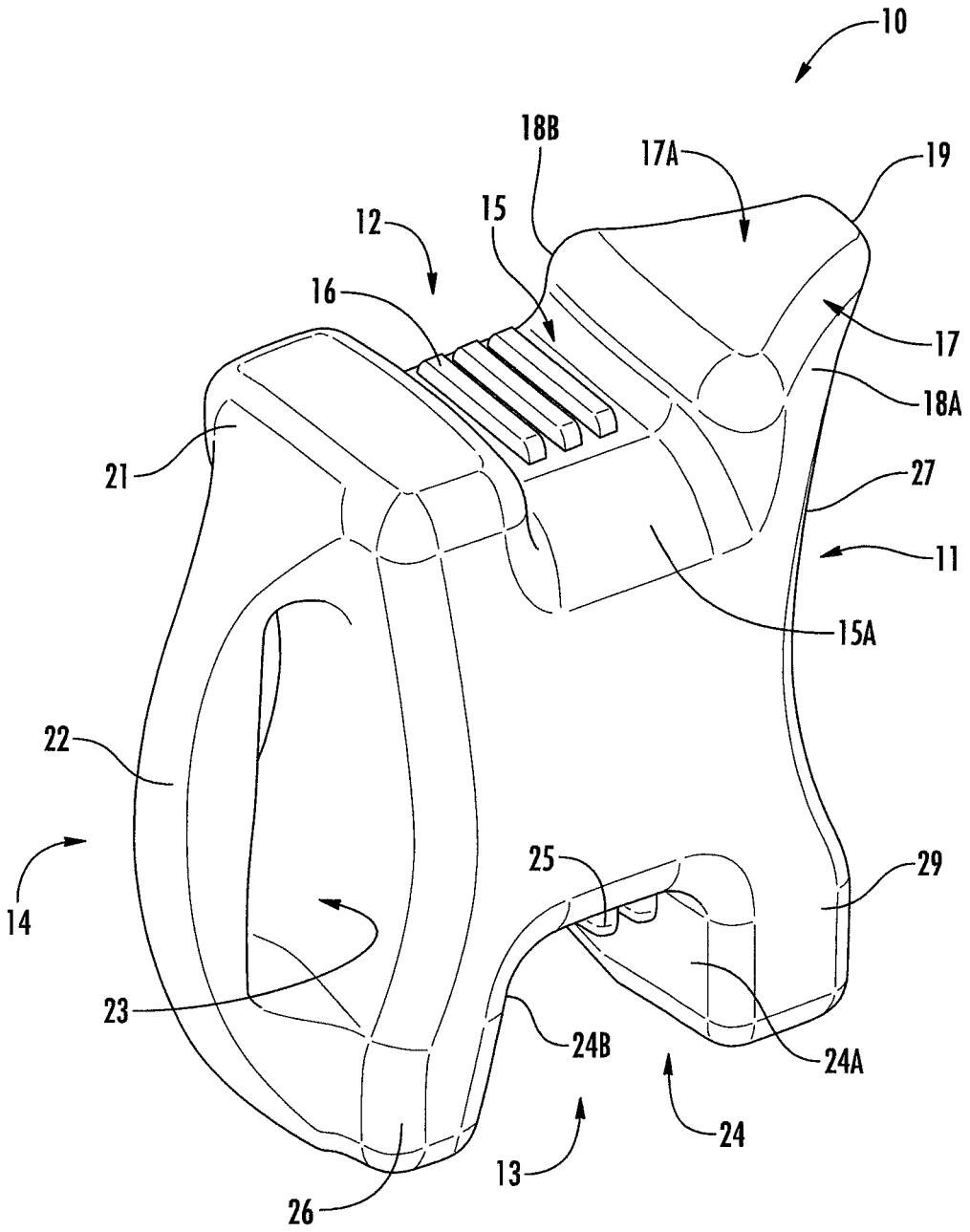
FIG. 1 is a perspective view of the invention.
Figure 4:
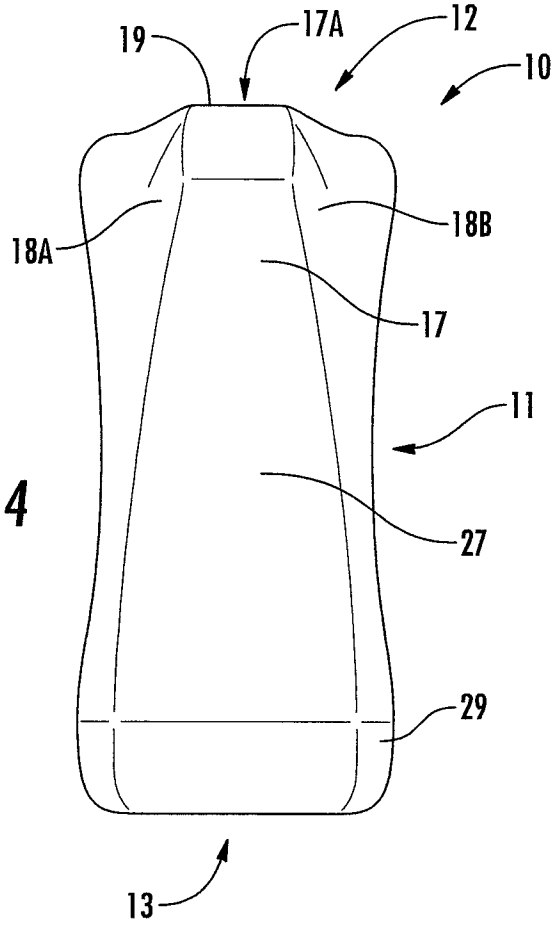
FIG. 4 is an end view on lines 4-4 of FIG. 3.
Figure 6:
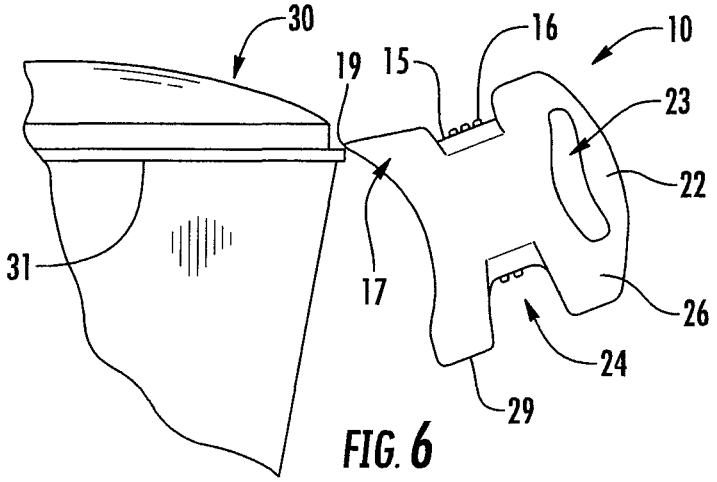
FIG. 6 is a graphic representation of the device engaging a container.

Referring to FIG. 1 of the drawings, a trash container lid engagement lift and prop device 10 of the invention can be seen having a monolithic body member 11 with a top and bottom engagement portions 12 and 13 and a handle end portion 14. The top engagement portion 12 has a central recessed retainment area 15 within and a plurality of spaced parallel registration ribs 16 thereon. An upstanding transversely tapered lid engagement end top area 17 extends from the central recessed area 15 having a flat upper top surface 17A defining a wedge configuration with oppositely disposed transversely tapered depending side surfaces 18A and 18B terminating at an end engagement point 19 as best seen in FIG. 4 of the drawings.

An upstanding handle attachment area 21 extends from the end of the central recessed area 15 in oppositely disposed relation to the hereinbefore disclosed tapered lid engagement end top area 17. It will be seen that the handle end portion 14 extends integrally therefrom with a depending curved handle 22 having adjacent elongated contoured access opening at 23 allowing for handle access of a user, not shown.

Figure 3:
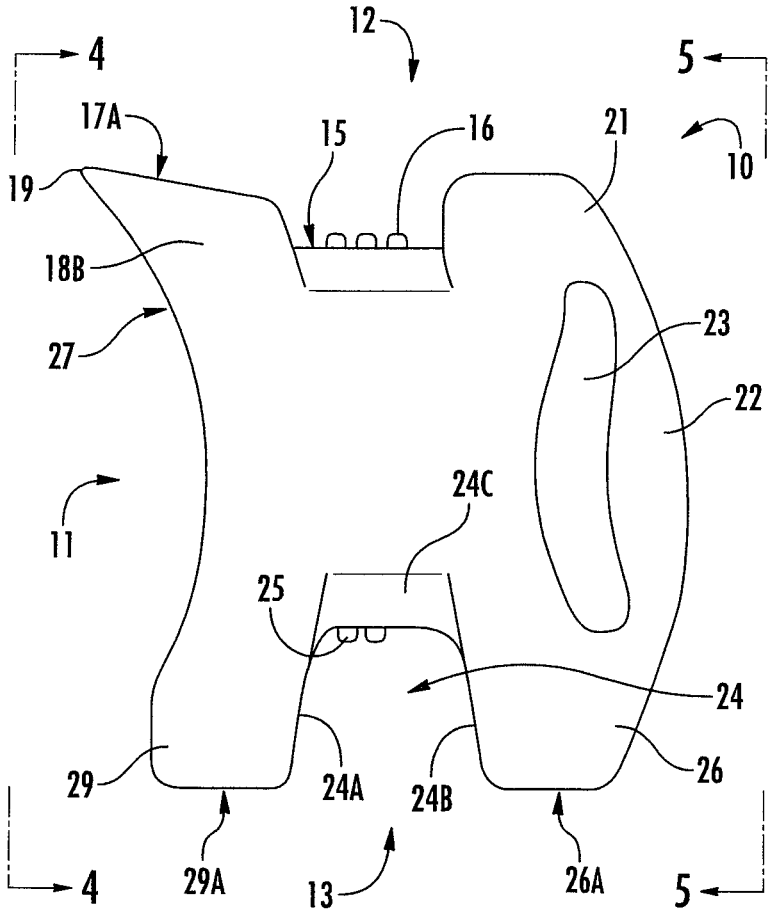
FIG. 3 is a front elevational view thereof.

Referring now to the bottom engagement portion 13, it will be seen as having a corresponding central bottom recessed retained area 24, in this example, with a pair of transversely extending spaced parallel ribs 25 thereon, as best seen in FIG. 3 of the drawings. A bottom depending handle support end portion 26 extends from one end of the recess portion 24 connecting to the curved handle 22 integrally.

The wedge-shaped end engagement point 19 has a depending curved front-end surface 27 that transitions into a vertically depending base end portion 29 defining the opposite end of the central bottom recess area portion 24.

The respective base end portion 29 and the hereinbefore described handle support base portion 26 both have flat bottom surfaces at 29A and 26A respectively in longitudinal alignment for free standing support when not in use.

Figure 7:
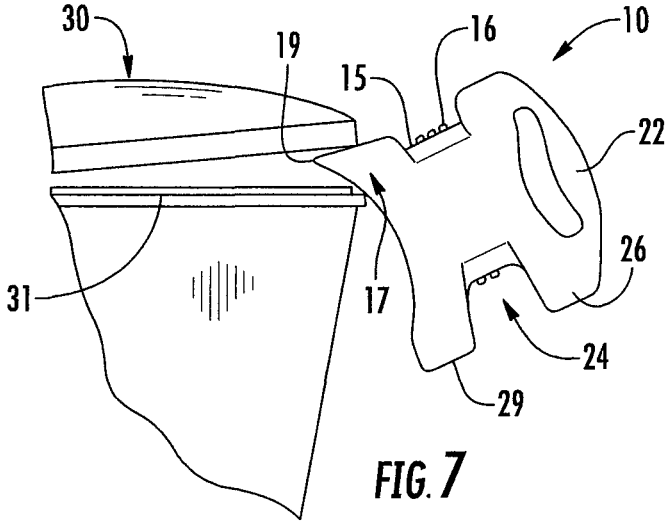
FIG. 7 is a graphic representation of the device engaged with the container.
Figure 8:
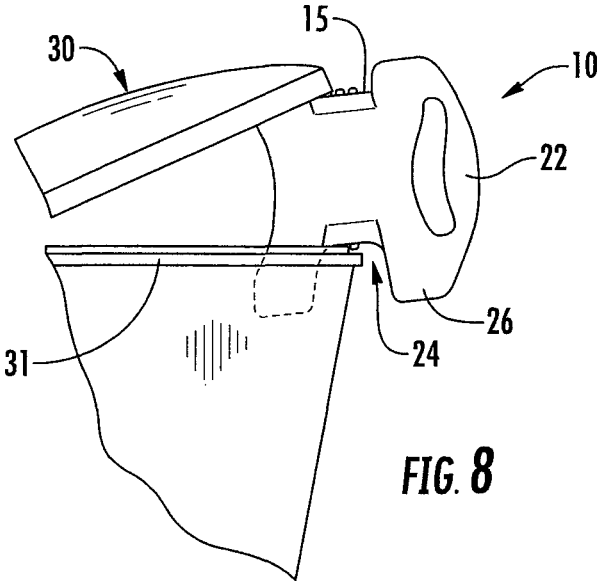
FIG. 8 is a graphic representation of the device engaged and holding the container lid open.
Figure 9:
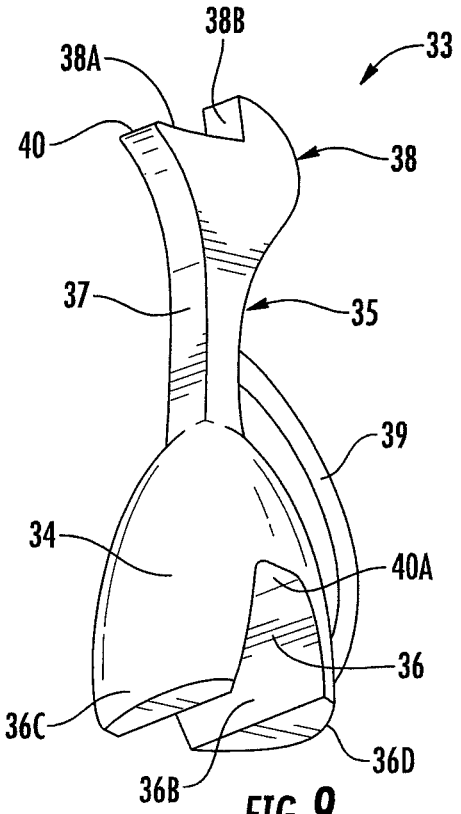
FIG. 9 is a perspective view of an alternate form of the invention.
Figure 10:
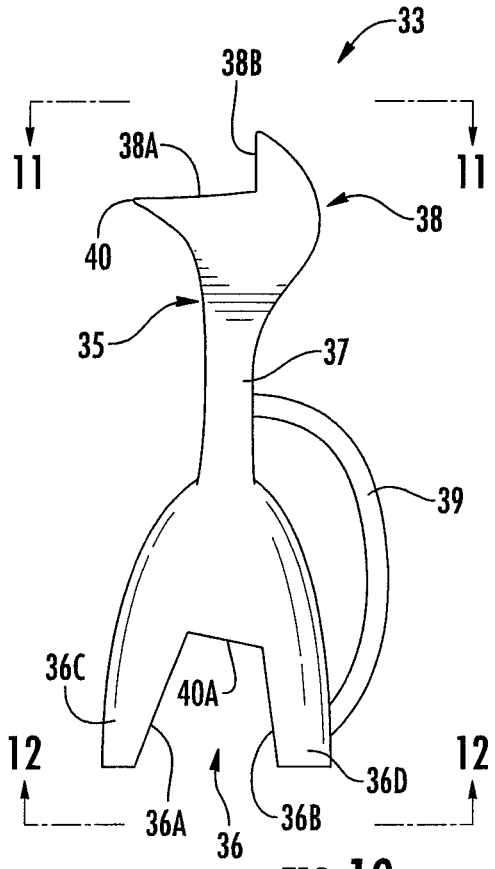
FIG. 10 is a side elevational view thereof.
Figure 11:
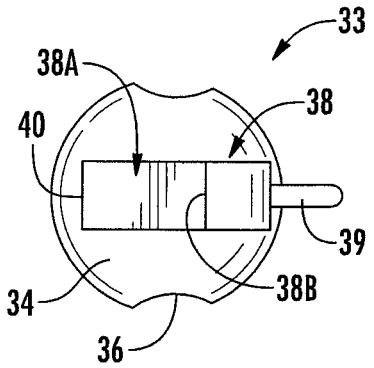
FIG. 11 is a top plan view thereof.
Figure 12:
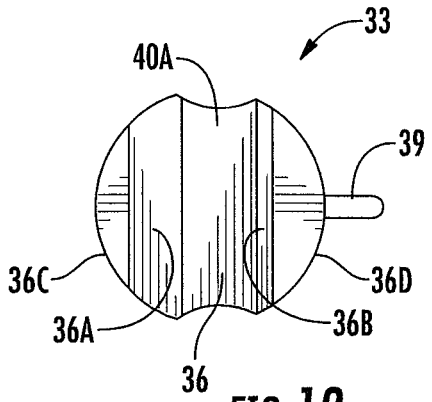
FIG. 12 is a bottom plan view thereof.

It will be evident from the above description that the lid engagement lift and prop device 10 of the invention defines a single handle engagement tool of sufficient dimension and scale that a user, not shown, can grasp the handle 22 one handed and insert forwardly facing the wedge shaped end point 19 easily between a wheeled trash container hinge lid 30 and container lip 31 lifting the lid 30 open and then being positioned there between with the lid 30 registerably engaging with the top central recessed area 15 and the lip 31 of the container engaged within the central bottom recess 24 thereby propping and holding the lid 30 open as seen sequentially in FIGS. 7, 8 and 9 of the drawings.

Figure 2:
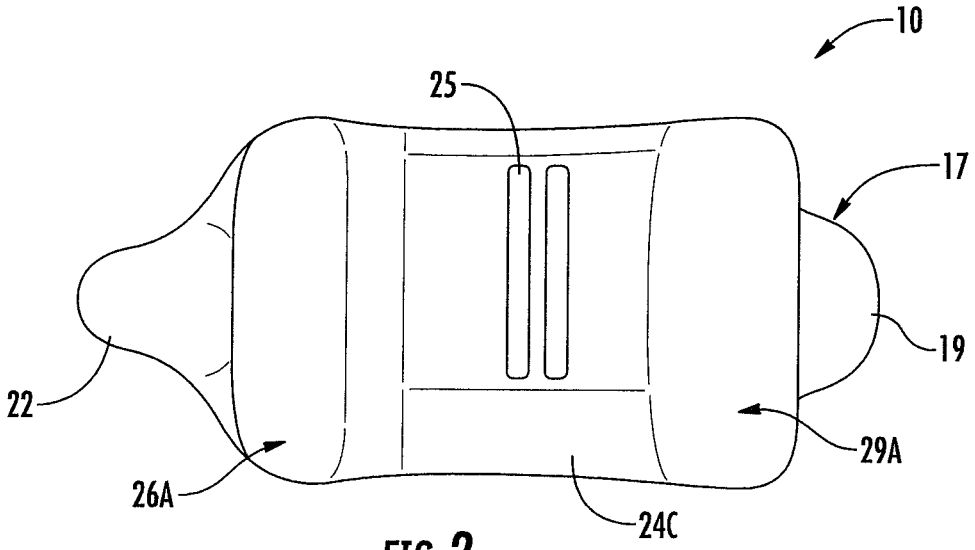
FIG. 2 is a bottom plan view thereof.

Removal of the lid engagement lift and prop device 10 is further aided by a curved shoulder area 15A in the recess area 15 as seen in FIG. 1 of the drawings and corresponding curved shoulder area 24C in the bottom recess retaining area 24 as best seen in FIGS. 2 and 3 of the drawings.

It will be seen that the reverse surface orientation of the shoulder area 15A and 24C afford reduced obstruction resistance during user directed rotational input of the device 10 required for ease of removal as described hereinafter.

Figure 5:
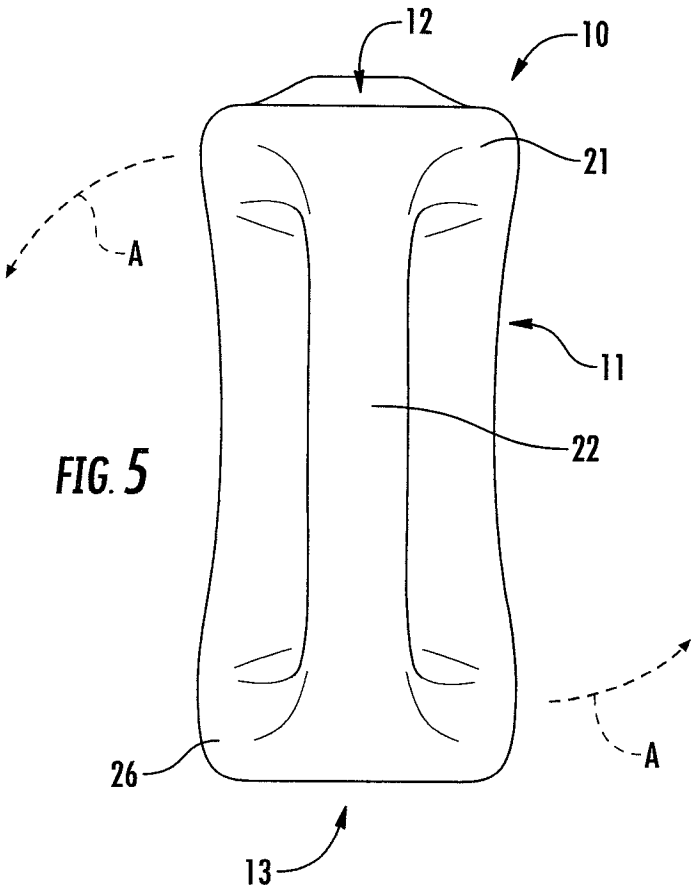
FIG. 5 is an end view on lines 5-5 of FIG. 3.

To remove the lid engagement and lift and hold device 10 is simply grasped by the handle 22 and rotated axially by the user indicated by directional arrows A in FIG. 5 of the drawings while maintaining their grip thereon and then removing from engagement between the container lid 30 and the container lip 31.

Referring back to FIGS. 2 and 3 of the drawings, the respective multiple registration ribs 16 and 25 are typically of equal length and dimensionality with one another and spaced so as to aid in the retainment positioning of the lid 30 and the container lip 31 respectively. It will also be noted that the bottom recess retainment area 24 has tapered respective side surfaces 24A and 24B so as to accommodate a wide variety of defined container wall constructions.

Referring now to FIGS. 9-12 of the drawings, an alternate form of the lid engagement lift and propping device 33 can be seen for dumpsters having a contoured engagement frusto-conical base 34 with an upstanding lid supporting neck 35. The base 34 has a central tapered recess 36 with oppositely disposed inclined sidewalls 36A and 36B there through defining a pair of flat bottom legs 36C and 36D. The lid support neck 35 has an elongated tapered portion 37 extending from the base 34 with an enlarged lid engagement notched free end portion 38.

A handle 39 extends from the neck 35 to the base leg 36D providing a user engagement grip thereon.

In use, a notch 38A defining a beak end 40 in the lid engagement notched end portion 38 with end wall 38B is wedgeably inserted between a dumpster's lid and wall lip, not shown, allowing the user to lift the lid with two hands as similar to previous form of the invention.

Once engaged and lifted, the alternate lid engagement lift and propping device 33, the base recess 36 is engaged over the dumpster wall lip supporting same in a retainment engagement action. It will be seen additionally that the engagement notch 38A within the notched end portion 38 is angularly disposed in relation to the corresponding spaced parallel co-planar flat bottom leg portions 36A and 36B which provides in use an angular offset orientation there between and in corresponding relation to an angularly disposed upper surface 40A within the bottom recess retainment 36 and sidewalls 36A and 36B as hereinbefore described, assuring retention once engaged.

It will thus be seen that a new and novel trash container dumpster lid engagement lift and prop devices 10 and 33 have been illustrated and described and it will be apparent to those skilled in the art that various changes and modification may be made therein without departing from the spirit of the invention. Therefore,

I claim:

1. A lid lift and retainment device for a trash container comprising, a main body member having a top engagement portion, a tapered top end portion and oppositely disposed top handle support with a top recess receiving area there between, a handle extending from said top handle support to a bottom disposed handle support base portion and defining an elongated contoured handle access opening within said body member, a bottom recess in said body member in vertical spaced relation to said top recess receiving area and a depending base end portion extend there from in spaced relation to said handle support base portion.

2. The lid lift and retainment device set forth in claim 1 wherein said tapered top end portion comprises, a flat upper top surface, oppositely disposed transversely tapered depending side surfaces defining a lid end engagement wedge shape point.

3. The lid lift and retainment device set forth in claim 1 wherein said top recess receiving area has a plurality of transverse spaced parallel ribs.

4. The lid lift and retainment device set forth in claim 1 wherein said depending handle support base and said base end portion have spaced co-planar flat bottom surfaces.

5. The lid lift and retainment device set forth in claim 1 wherein said bottom recess in said body member has a plurality of transverse spaced parallel ribs thereon.

6. The lid lift and retainment device set forth in claim 1 wherein said tapered top end portion further comprises, a depending curved front-end surface transitioning to said depending base end portion.

7. The lid lift and retainment device set forth in claim 1 wherein said top recess receiving area further includes a curved shoulder area between said tapered top end portion and said top hand support portion.

8. The lid lift and retainment device set forth in claim 1 wherein said bottom recess in said body member further comprises, curved shoulder area between said depending base end portion and said handle support base portion.

* * * * *